US005203715A

United States Patent [19]

Yamamoto

[11] Patent Number: 5,203,715

[45] Date of Patent: Apr. 20, 1993

[54] CONNECTOR

[75] Inventor: Takayuki Yamamoto, Shizuoka, Japan

[73] Assignee: Yazaki Corporation, Japan

[21] Appl. No.: 850,844

[22] Filed: Mar. 13, 1992

[30] Foreign Application Priority Data

Mar. 13, 1991 [JP] Japan ..... 3-14425[U]

[51] Int. Cl.[5] ..... H01R 13/627

[52] U.S. Cl. ..... 439/354; 439/357

[58] Field of Search ..... 439/345, 350, 352, 353, 439/354, 355, 357, 358

[56] References Cited

U.S. PATENT DOCUMENTS

| | | | |
|---|---|---|---|
| 4,214,804 | 7/1980 | Otani et al. | 439/354 X |
| 4,884,978 | 12/1989 | Inaba et al. | 439/354 X |
| 4,946,395 | 8/1990 | Cope et al. | 439/352 |
| 4,979,910 | 12/1990 | Revil et al. | 439/357 |

FOREIGN PATENT DOCUMENTS

| | | |
|---|---|---|
| 0356157 | 2/1990 | European Pat. Off. . |
| 0382157 | 2/1990 | European Pat. Off. . |
| 92104386 | 9/1992 | European Pat. Off. . |
| 62-25480 | 2/1987 | Japan . |
| 62-76482 | 5/1987 | Japan . |
| 6448885 | 3/1989 | Japan . |
| 1-165582 | 11/1989 | Japan . |
| 1103184 | 7/1991 | Japan . |

*Primary Examiner*—Larry I. Schwartz
*Assistant Examiner*—Khiem Nguyen
*Attorney, Agent, or Firm*—Wigman & Cohen

[57] ABSTRACT

A connector includes a first housinng and a second housing fitted to each other. The first housing has an engaging portion and the second housing has an elastic lock arm. The front end in an inserting direction of the elastic lock arm is integally connected to the second housing. The elastic lock arm extends in the inserting direction, which rear end in the inserting direction forms a free end. A lock projection is integrally formed on the elastic lock arm. The lock projection engages the engaging portion to be depressed by the engaging portion when fitting the second housing to the first housing, and has a first sliding face sliding on the engaging portion when depressed by the engaging portion. The first sliding face is formed such that an inclination angle thereof is substantially the same as a maximum bending angle of the elastic lock arm. The lock projection has a second sliding face disposed on a front side of the first sliding face.

3 Claims, 8 Drawing Sheets

CONNECTOR

BACKGROUND OF THE INVENTION

This invention relates to a connector used for electrically connecting a pair of terminals.

A conventional connector of this kind includes, for example, a connector shown in FIG. 1 (Japanese Utility Model Laid Open Publication No. 1-103184).

FIG. 1 shows a sectional view of a connector for housing terminals normally provided therein, the terminals being omitted for the sake of clarity. The connector is provided with a female housing 1 and a male housing 3 other. The female housing 1 has a fitting hood 5 with a engaging portion 7 at an edge thereof. The male housing 3 has an elastic lock arm 11 with a lock projection 9. When the male and female housings 1, 3 are fitted together as shown in FIG. 1, the lock projection 9 engages the engaging portion 7 to lock the male and female housings 1, 3 together. In this connector, the lock arm 9 has a sliding face 13 inclined in an inserting direction on a front side of the male housing 3, and forms a triangle in a section thereof.

A lock operation of the elastic lock arm 11 with the lock projection 9 will be described hereinafter with reference to FIG. 2.

When the male and female housing 1, 3 are fitted together, theelastic lock arm 11 moves to the fitting hood 5 in the order shown in FIGS. 2A, 2B and 2C, and finally the lock projection 9 engages the engaging portion 7.

In this operation, first the sliding face 13 of the lock projection 9 comes into contact with the engaging portion 7. Second the sliding face 13 slides on the engaging portion 7 as the male housing 3 is inserted, and when the lock projection 13 moves to a position shown in FIG. 2C, the lock projection 13 is disengaged from the engaging portion 7 to lock the fitted condition. At that moment, the elastic lock arm 11 collides with the engaging portion 7 to produce a clicking sound, so that an operator can confirm the full-fitting condition.

In addition, the inserting force during the fitting of the male housing 3 is shown in FIG. 3 with relation to a stroke of insertion. In FIG. 3, the references (a), (b) and (c) correspond to FIGS. 2A, 2B and 2C respectively. In FIG. 3, suppose that the condition shown in FIG. 2A is at stroke zero (0), and the stroke is increased as shown in FIG. 2B and FIG. 2C, because the flexure of the elastic lock arm 11 increases with the inclination of the sliding face 13. The inserting force gradually increases with the advance of the elastic lock arm 11 shown in FIGS. 2A, 2B and 2C, and the inserting force rapidly becomes zero (0) when the lock projection 9 is locked to the engaging portion 7.

Since the inserting force changes as shown in FIG. 3 in the connector with a lock projection 9 the section of which is triangular, the inserting force even before the condition shown in FIG. 2C is considerably large. Therefore, there is a fear that an operator decides that the connector is in a completely fitted condition due to the increase in the inserting force and stop the insertion of the male housing 3 thereby bringing about an incomplete fitting.

In order to settle the above-described problem, there is a connector having an elastic lock arm 11 with a lock projection 15 shown in FIG. 4 (Japanese Utility Model Laid Open Publication No. 62-76482). This lock projection 15 is provided with a raised sliding face 17 substantially parallel to the extending direction of the elastic lock arm 11 extending in the inserting direction of the male housing 3 and with a initial sliding face 19 disposed on the front side of the raised sliding face 17. Consequently, in this connector, the locking operation of the elastic lock arm 11 is executed as shown in FIGS. 5A through 5F as the insertion of the male housing 3 advances.

First, the initial slide face 19 comes in contact with the engaging portion 7 by the insertion of the male housing 3, so that the engaging lock arm 11 starts to bend. In the condition shown in FIG. 5A in which a front end 17*a* of the raised sliding face 17 depressed by the engaging portion 7, the elastic lock arm 11 forms the maximum bending angle $\theta$ with the inserting direction. In this condition, the rear end 17*b* of the raised slide face 17 forms the maximum height H with the engaging portion 7. The maximum height H is maintained until the instant the front end 17*a* of the raised sliding face 17 is disengaged from the engaging portion 7 to the lock side. Next, the raised sliding face 17 slides down the engaging portion as shown in FIG. 5C, and the rear end 17*b* of the raised sliding face 17 slides on the engaging portion 7 as shown in FIG. 5D and 5E. During this movement of the rear end 17*b* as shown in FIG. 5B through FIG. 5E, the bending angle of the elastic lock arm 11 is gradually decreased from the maximum bending angle $\theta$. When the rear end 17*b* of the raised slide face 17 is disengaged from the engaging portion to the lock side, the lock projection 15 is locked to the engaging portion 7 as shown in FIG. 5F.

The relationship between the stroke of the movement of the elastic lock arm 11 and the magnitude of the inserting force is shown in FIG. 6. The marks of reference (a) through (f) in FIG. 6 correspond to FIGS. 5A through 5F. In the condition shown in FIG. 5A, because the elastic lock arm 11 is bent at the maximum bending angle $\theta$, the inserting force indicates the maximum value as shown in FIG. 6. When the lock projection 15 moves slightly away from this condition, the inserting force is decreased as shown to (a)' in FIG. 6, and then the value of the inserting force is maintained at a constant value to (b). After that, the value of the inserting force is gradually decreased as shown in sequential order to (c), (d), (e) and indicates zero (0) at (f).

In this manner, in the conventional connector, the inserting force indicates a maximum value (a) at an initial time and then passes through a constant condition and a decreasing condition to reach a locked condition. Therefore, this connector is called an inertia lock type. That is, an operator is required to provide a certain degree of an inserting force at an initial time in the inserting operation, but after that time because the inserting force is rapidly decreasing, the operator can insert the male housing 3 into the female housing 1 without stopping (by inertia). Consequently, there is an advantage that it is possible to prevent an incompletely fitting condition in comparison with the connector shown in FIG. 3.

However, in this inertia lock type, the inserting force is gradually decreased with the advance of the stroke from (b) to (e) as shown in FIG. 6. For this reason, at the time that the lock projection 15 disengaged from the engaging portion 7 to reach the locked condition as shown by (f), the collision force between the elastic lock arm 11 and the engaging portion 7 becomes small, so that the click sounds becomes small. Thus, there has been a problem that an operator cannot auditorily recognize the completely fitted condition.

SUMMARY OF THE INVENTION

It is an object of the present invention to provide a connector which can increase a click sound in the inertia lock type connector.

This and other objects can be achieved according to the present invention by providing a connector comprising:

a first housing;

a second housing fitted to said first housing;

an engaging portion disposed in said first housing;

an elastic lock arm having a front end of which in an inserting direction is integrally connected to said second housing, said elastic lock arm extending in the inserting direction, a rear end of which in the inserting direction forms a free end; and a lock projection integrally formed on said lock arm, engaging said engaging portion to be depressed by said engaging portion when fitting said second housing to said first housing, having a first sliding face sliding on said engaging portion when depressed by said engaging portion, said first sliding face formed such that an inclination angle of said first sliding face is substantially the same as a maximum bending angle of said elastic lock arm; said lock projection having a second sliding face disposed on a front side of said first sliding face.

According to this invention, since the angle of inclination of the first sliding face is substantially the same as the maximum bending angle of the elastic lock arm, it is possible to maintain the maximum bending angle of the elastic lock arm from the beginning to the end of the sliding of the first sliding face on the engaging portion face.

DETAILED DESCRIPTION OF THE PREFERRED EMBODIMENTS

Figure 1:
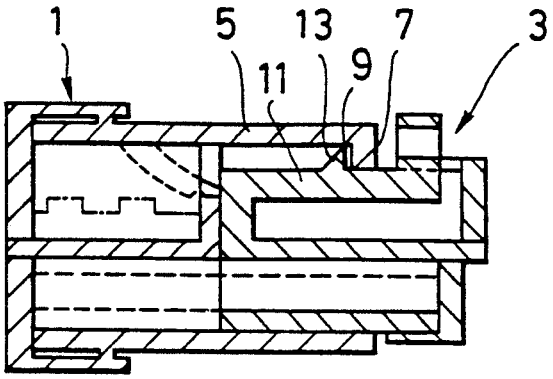
FIG. 1 PRIOR ART
FIG. 1 is a sectional view showing a conventional connector.
Figure 2A:
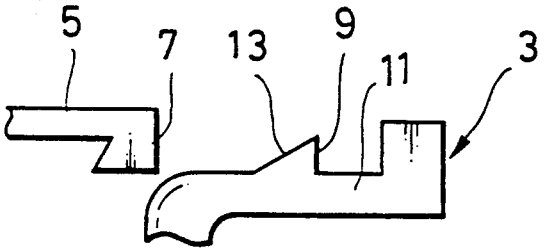
FIG. 2A PRIOR ART
FIGS. 2A, 2B and 2C are partial view showing a locking operation of the connector shown in FIG. 1.
Figure 2B:
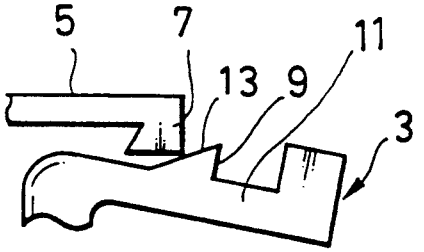
FIG. 2B PRIOR ART
Figure 2C:
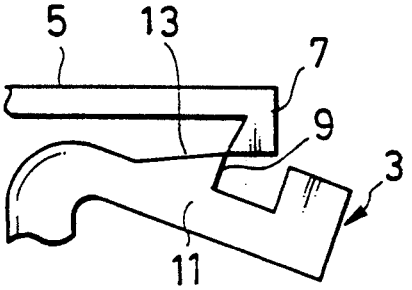
FIG. 2C PRIOR ART
Figure 3:
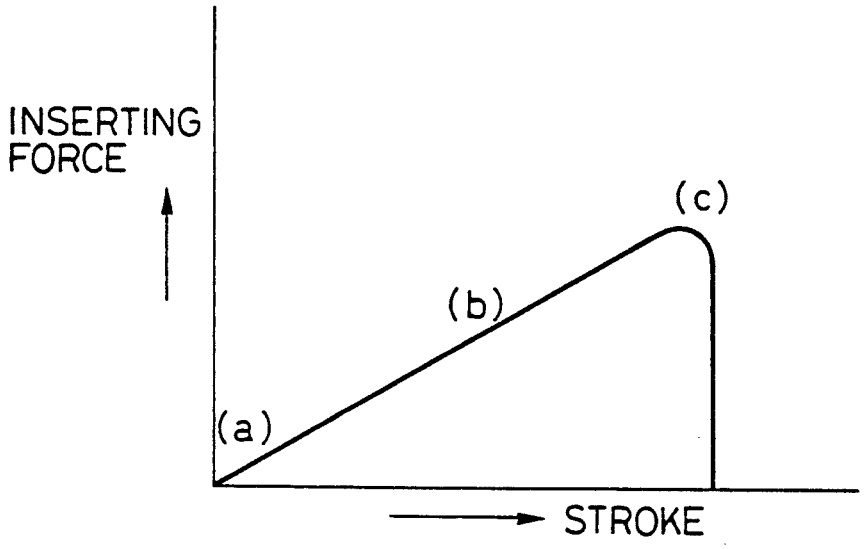
FIG. 3 PRIOR ART
FIG. 3 is a graph showing a relationship between a stroke and an inserting force in the connector shown in FIG. 1.
Figure 4:
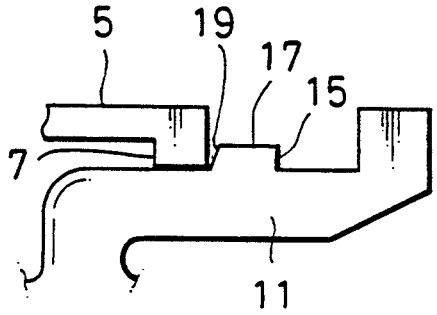
FIG. 4 PRIOR ART
FIG. 4 is a partial view showing another conventional connector.
Figure 5A:
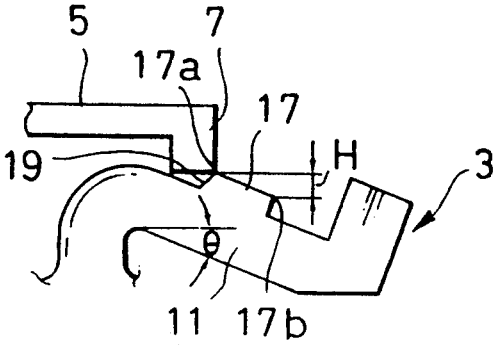
FIG. 5A PRIOR ART
FIGS. 5A, 5B, 5C, 5D, 5E and 5F are partial view showing a locking operation of the connector shown in FIG. 4.
Figure 5B:
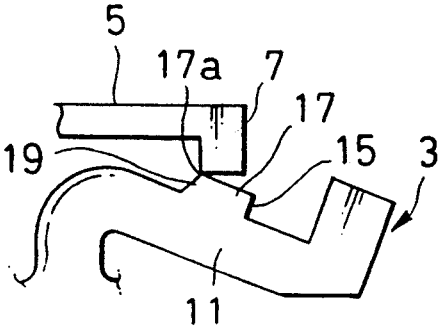
FIG. 5B PRIOR ART
Figure 5C:
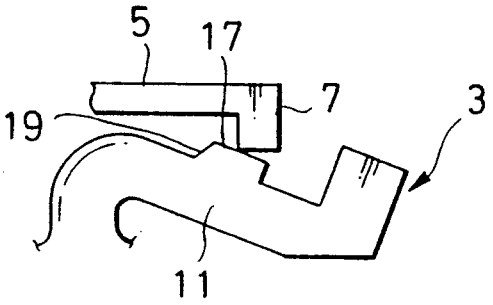
FIG. 5C PRIOR ART
Figure 5D:
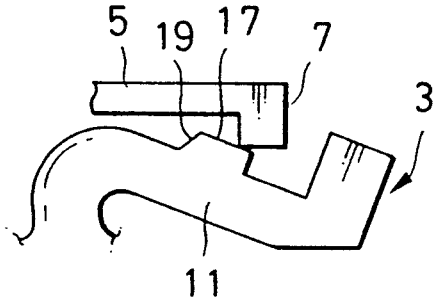
FIG. 5D PRIOR ART
Figure 5E:
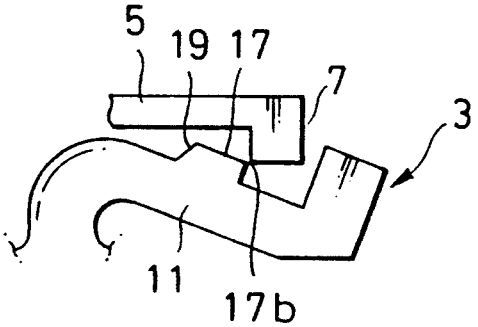
FIG. 5E PRIOR ART
Figure 5F:
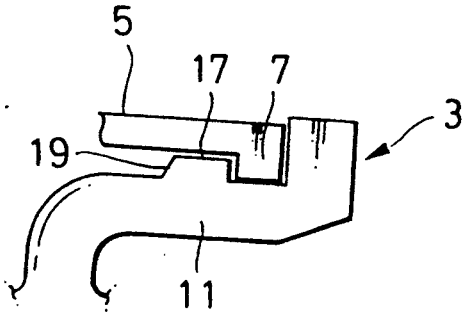
FIG. 5F PRIOR ART
Figure 6:
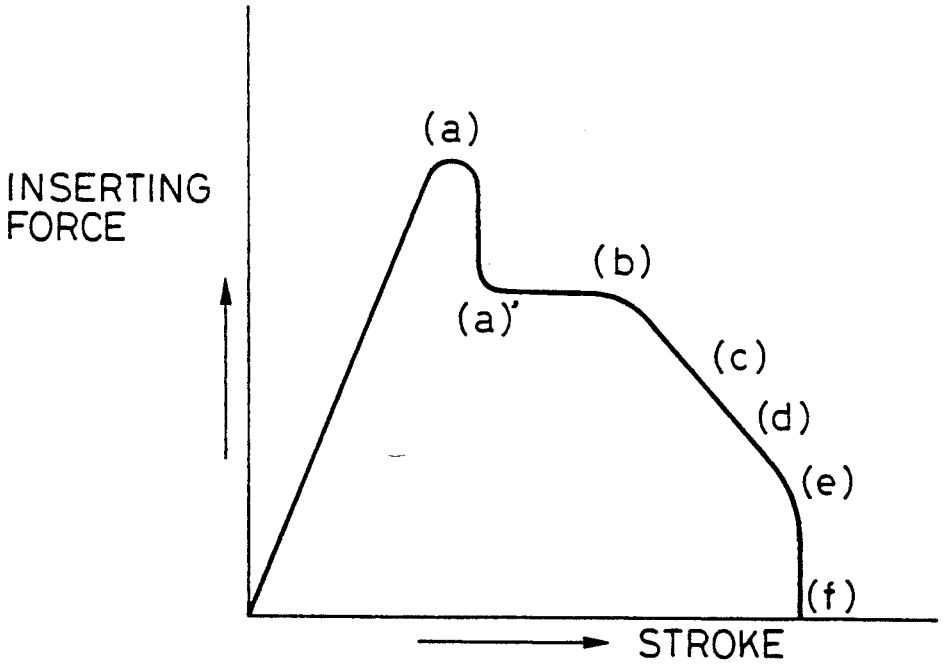
FIG. 6 PRIOR ART
FIG. 6 is a graph showing a relationship between a stroke and an inserting force in the connector shown in FIG. 4.
Figure 7:
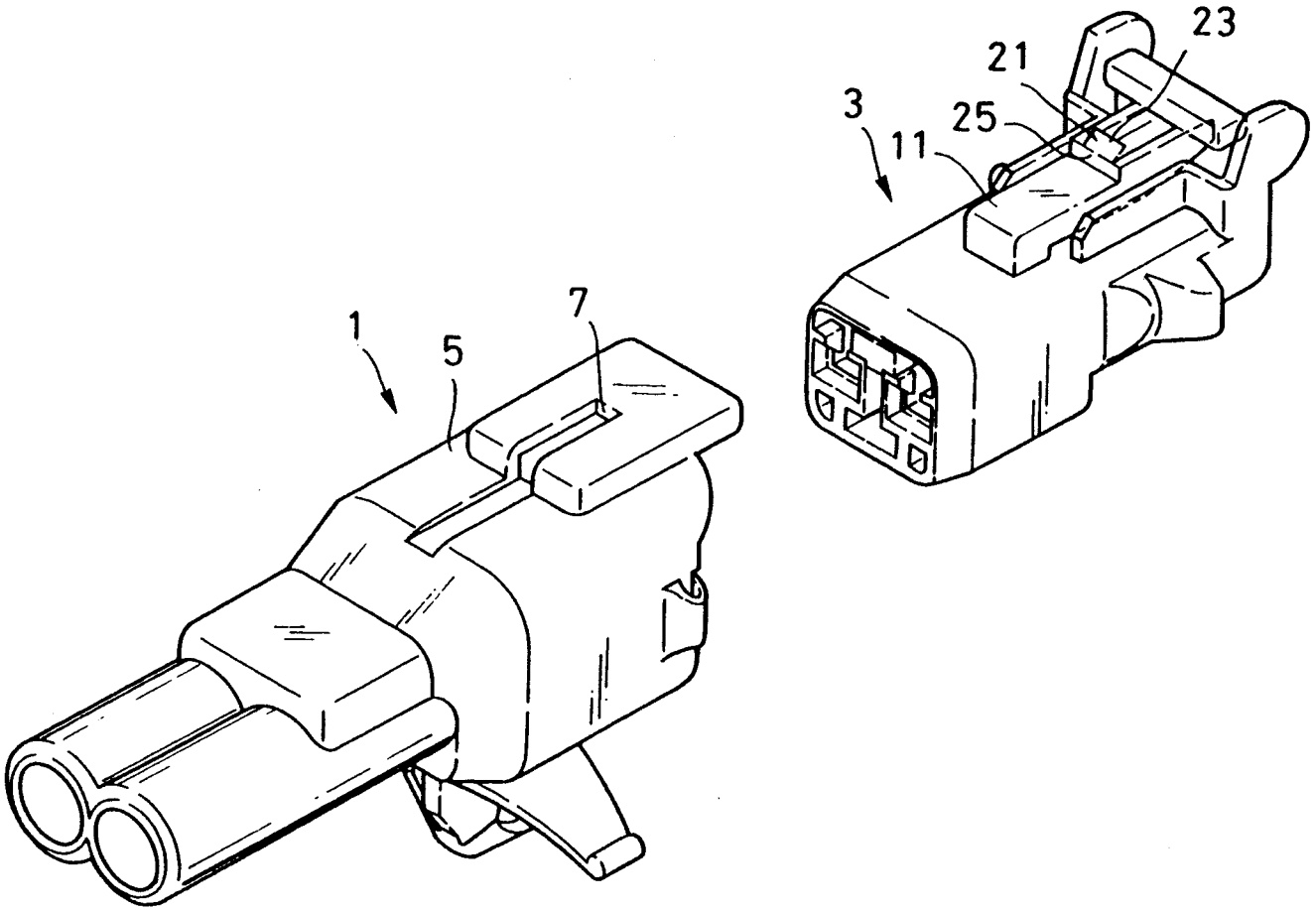
FIG. 7 is a perspective view showing a connector according to this invention.

Referring to FIG. 7, a connector is provided with a female housing 1 and a male housing 3. The female housing 1 has a fitting hood 5 with a engaging portion 7. The male housing has an elastic lock arm 11 to engage the engaging portion 7 of the female housing 1.

Figure 8:
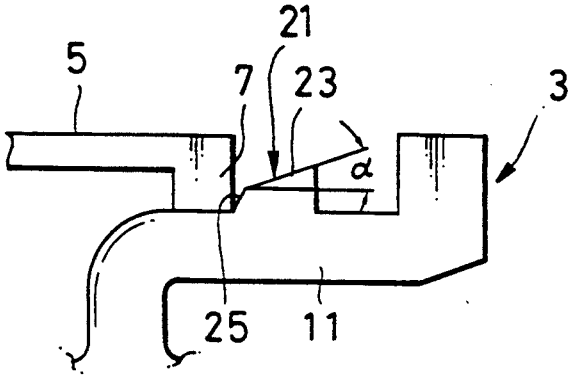
FIG. 8 is a partial view showing a connector shown in FIG. 7, and in particular showing an angle of inclination of the first sliding face.
Figure 9:
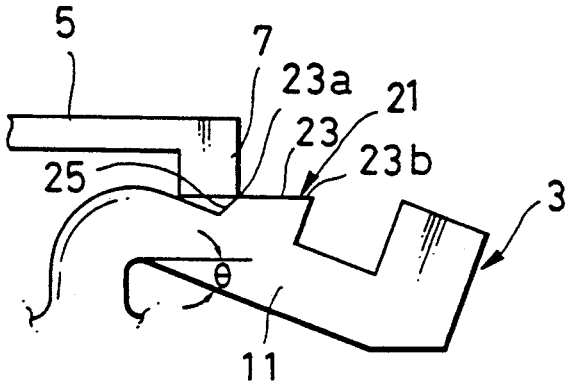
FIG. 9 is a partial view showing a connector shown in FIG. 7, and in particular showing the maximum bending angle of an elastic lock arm.

The elastic lock arm 11 is integrally connected to a body of the male housing 3 at the front end in the inserting direction of the male housing 3 and extends in the inserting direction. The rear end of the elastic lock arm 11 is free to form a cantilever. A lock projection 21 is formed on the upper face of the elastic lock arm 11. The lock projection 21 abuts against the engaging portion 7 to bend the elastic lock arm 11 at the fitting of the connector, and finally engages the engaging portion 7. The lock projection 21 is provided with a raised sliding face (the first sliding face) 23 on the upper surface thereof. The inclination angle $\alpha$ of the raised sliding face 23 shown in FIG. 8 is substantially the same as the maximum bending angle $\theta$ of the elastic lock arm 11 shown in FIG. 9. An initial sliding face (the second sliding face) 25 is formed on the front side of the raised sliding face 23. The initial sliding face 25 crosses to the upper surface of the elastic lock arm 11 at a more obtuse angle than that of the raised sliding face 23. That is, the initial sliding face 25 is more steep than the raising sliding face 23.

When the male housing 3 is inserted into the female housing 1, first the initial sliding face 25 of the lock projection 21 abuts against the engaging portion 7, the front end **23*a* of the depressed sliding face 23 depressed by the engaging portion 7 to bend the elastic lock arm 11** at the maximum bending angle $\theta$.

Figure 10A:
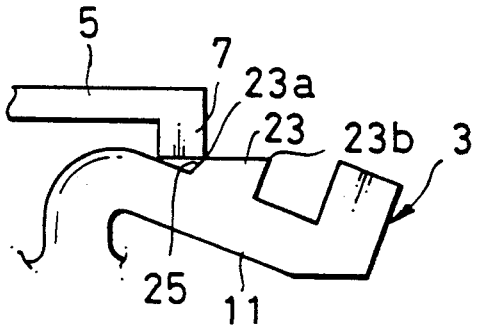
FIGS. 10A, 10B, 10C, 10D, 10E and 10F are partial views showing a locking operation of the connector shown in FIG. 7.
Figure 10B:
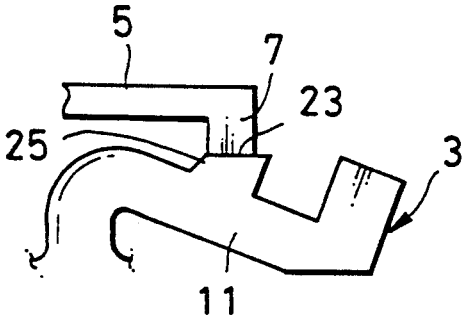
Figure 10C:
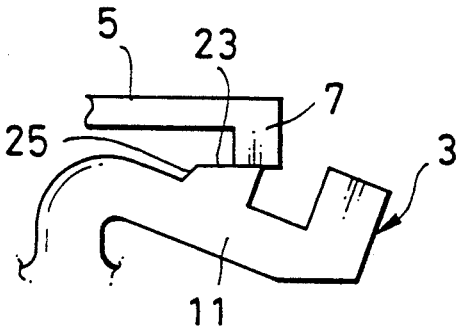
Figure 10D:
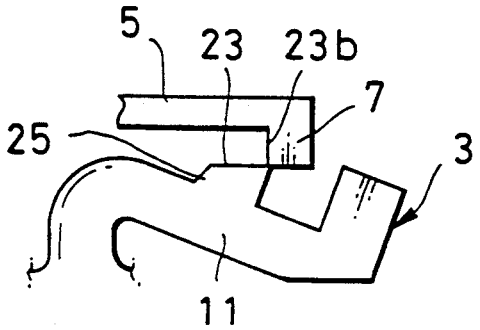
Figure 10E:
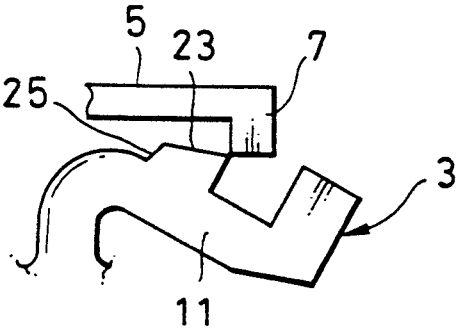
Figure 10F:
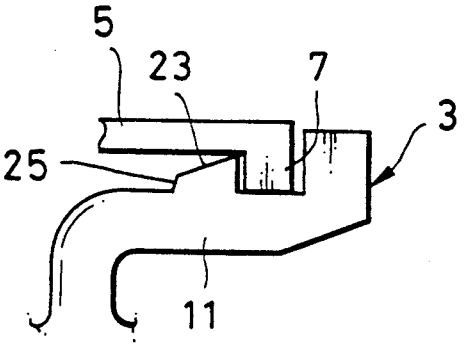

Explaining this locking operation with reference to FIG. 10A, 10B, 10C, 10D, 10E and 10F in detail, when the front side **23*a* of the raised sliding face 23 climbs over the engaging portion 7 to bend the elastic lock arm 11 at the maximum bending angle $\theta$, the raised sliding face 23 becomes substantially parallel to the inserting direction. As the insertion advances, the raised sliding face 23 slides on the engaging portion 7 as shown in FIG. 10B and 10C. During this movement, the maximum bending angle $\theta$ is maintained as it stands. The maximum bending angle $\theta$ of the elastic lock arm 11 is maintained until the instant that the rear end 23*b* of the raised side surface 23 reaches the position shown in FIG. 10D which is just before the disengagement of the rear end 23*b* from the engaging portion 7. When the rear end 23*b* of the raised sliding face 23 is disengaged from the engaging portion 7, the elastic lock arm 11 rapidly reaches the condition shown in FIG. 10F, so that the lock projection 21 is locked to the engaging portion 7**.

Figure 11:
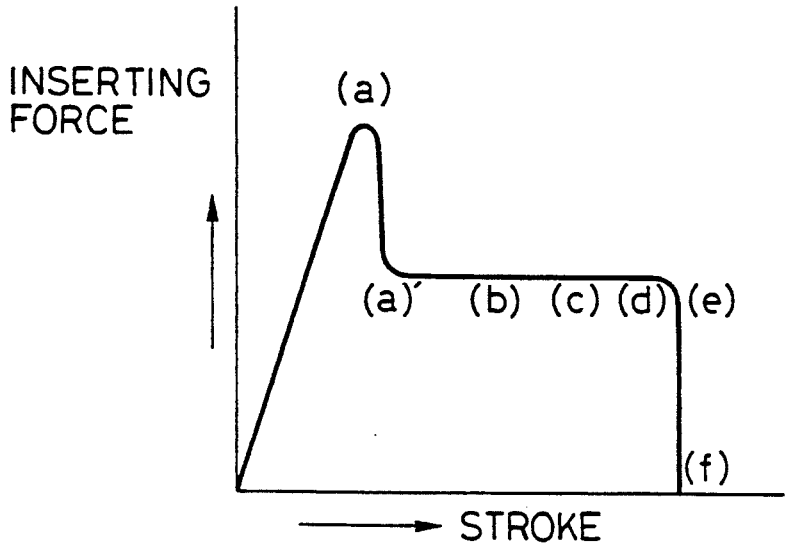
FIG. 11 is a graph showing a relationship between a stroke and an inserting force in the connector shown in FIG. 7.

In this connector, the relationship between the stroke of the fitting motion and the inserting force is shown in FIG. 11. In FIG. 11, the marks of reference (a) through (f) correspond to FIGS. 10A through 10F. As shown in FIG. 11, the inserting force reaches the peak at an initial time of the insertion due to the initial sliding face 25 as shown by (a). When the raised sliding surface 23 starts to slide on the engaging portion 7, the inserting force is decreased as shown by (a)'. After that, the inserting force is maintained at a constant value from (a)' through (e), and the inserting force is rapidly decreased to zero (O) from the condition (e) to (f).

Consequently, since the inserting force is rapidly decreased from a certain value to zero (0), the change in the inserting force from (e) to (f). Therefore, the click produced by colliding of the elastic lock arm 11 against the engaging portion 7 can be increased. For this reason, the click sound at the completely fitted instant becomes more clear, so that an operator can easily auditorily confirm the completely fitted condition. In addition, since this connector is of the so-called inertia lock type, there is no fear that the operator stops the insertion of the male housing 3 at an incompletely fitted condition.

In this connection, the inclination angle $\alpha$ of the raised sliding face 23 may not be completely the same as the maximum bending angle $\theta$. The inclination angle $\alpha$ of the raised sliding face 23 may be slightly larger or smaller than the maximum bending angle $\theta$.

Figure 12:
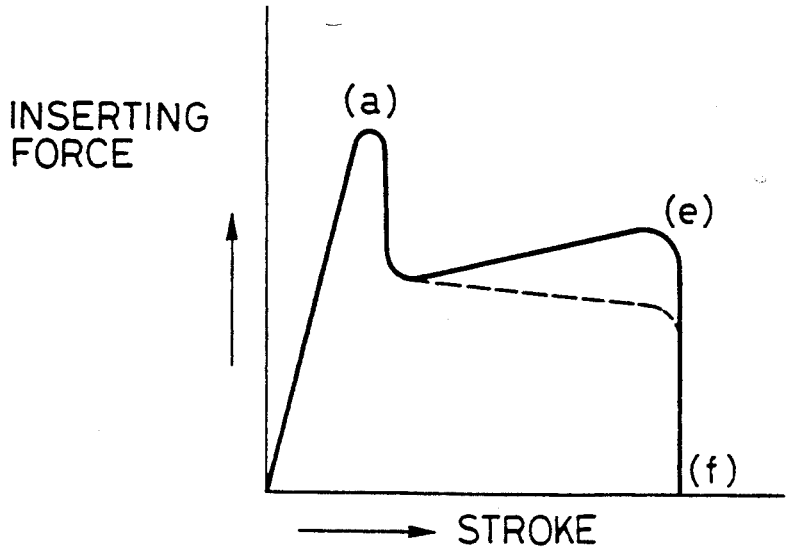
FIG. 12 is a graph showing a relationship between a stroke and an inserting force in other embodiments of connectors according to this invention.

FIG. 12 indicates other embodiments according to this invention. In FIG. 12, the solid line indicates an embodiment that the inclination angle $\alpha$ is slightly larger than the maximum bending angle $\theta$. In this embodiment, the inserting force is initially increased, decreased once, and then gradually increased to (e). However, in this case the inserting force at (e) should be lower than the inserting force at (a).

The dotted line in FIG. 12 indicates an embodiment in which the inclination angle $\alpha$ is slightly larger than the maximum bending angle $\theta$. In this embodiment, the inserting force is initially increased, decreased once, and then gradually decreased to (e).

What is claimed is:

1. A connector comprising;

a first housing;

a second housing fitted to said first housing;

an engaging portion disposed in said first housing;

an elastic lock arm having a front end of which in an inserting direction is integrally connected to said second housing, said elastic lock arm extending in the inserting direction, a rear end of which in the inserting direction forms a free end; and a lock projection integrally formed on said lock arm, engaging said engaging portion to be depressed by said engaging portion when fitting said second housing to said first housing, having a first sliding face sliding on said engaging portion when depressed by said engaging portion, said first sliding face formed such that an inclination angle of said first sliding face is substantially the same as a maximum bending angle of said elastic lock arm relative to the inserting direction; said lock projection having a second sliding face disposed on a front side of said first sliding face.

2. A connector according to claim 1, wherein said inclination angle of said first sliding face in the inserting direction is slightly larger than the maximum bending angle.

3. A connector according to claim 1, wherein said inclination angle of said first sliding face in the inserting direction is slightly smaller than the maximum bending angle.

* * * * *